US006202525B1

(12) United States Patent
Hendrickson et al.

(10) Patent No.: US 6,202,525 B1
(45) Date of Patent: Mar. 20, 2001

(54) CHOPPING APPARATUS

(75) Inventors: Harold Miles Hendrickson, Delta; Randall Clark Bascom, Wauseon, both of OH (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/030,143

(22) Filed: Feb. 25, 1998

(51) Int. Cl.[7] ..... B26D 7/10; B26D 7/08

(52) U.S. Cl. ..... 83/16; 83/169; 83/171; 83/346.3; 83/673.4; 83/913

(58) Field of Search ..... 83/913, 169, 171, 83/346–48, 673–74, 698, 663; 451/53, 450, 483

(56) References Cited

U.S. PATENT DOCUMENTS 3,508,461 * 4/1970 Stream ..... 83/913 X
3,648,554 * 3/1972 Arnold et al. ..... 83/169
3,831,481 * 8/1974 Van Doorn et al. ..... 83/674
3,979,981 * 9/1976 Lightstone et al. ..... 83/170 X
4,083,278 * 4/1978 Steffan ..... 83/169
4,083,279 * 4/1978 Wester et al. ..... 83/347
4,091,580 * 5/1978 Oates ..... 83/169 X
4,175,939 * 11/1979 Nakazawa et al. ..... 83/913 X
4,344,786 * 8/1982 Symborski et al. ..... 83/913 X
4,373,650 * 2/1983 Gay ..... 83/663 X
4,398,934 * 8/1983 Willis et al. ..... 83/347 X
4,406,196 * 9/1983 Roncato et al. ..... 83/347 X
5,103,701 * 4/1992 Lundin et al. ..... 82/173
5,207,815 * 5/1993 Wright ..... 83/171 X
5,711,492 * 1/1998 Cheladze ..... 241/220
5,785,581 * 7/1998 Settles ..... 451/53 X

* cited by examiner

*Primary Examiner*—M. Rachuba
(74) *Attorney, Agent, or Firm*—John H. Miller

(57) ABSTRACT

Apparatus and method for separating or chopping long fibers or the like are improved by maintaining the temperature of one or more temperature sensitive components of the chopping apparatus with cooling means to maintain one or more desired characteristic of the material within a desired range. The invention increases the effectiveness of a chopper.

25 Claims, 4 Drawing Sheets

CHOPPING APPARATUS

BACKGROUND

This invention pertains to apparatus and methods for separating or chopping, such as cutting, shearing or breaking long or continuous things like fiber, strand, ribbon, tape, etc. into short lengths and is an improvement in the prior art apparatus and methods for so separating such long or continuous things. The invention is particularly useful for separating long or continuous strands made up of individual fibers of glass, ceramic, mineral or organic polymer into short segments such as up to 3 inches or more in length. For example, fibers are pulled from molten glass, molten polymer, etc. flowing through a multitude of holes or nozzles in a high temperature bushing to form one or more strands. Some products require separating these fibers or strands of fibers into short lengths. Glass, mineral or ceramic fibers are particularly hard to separate because of their hardness and abrasiveness.

Things like fiber, ribbon, tape, etc. and strands made up of a plurality of one or more of these or similar things, are typically made in continuous form or in long lengths. Continuous, as used here, means very long lengths such as more than a hundred feet long and typically includes things that are thousands of feet and even miles long. Such things, such as fiber and fiber strands, must be separated into short lengths, typically between about 0.16 up to 3 inches or longer. The fibers often are very hard to separate into smaller lengths due to their hardness and/or toughness and/or due to one or more chemicals on their surface, placed there to protect the surface, and which often contain a lubricant.

Apparatus currently known for separating or chopping are designed to operate to work product speeds of hundreds and often thousands of feet per minute. Often the capability of this apparatus is the limiting item in the operating speed of the entire manufacturing process for making the chopped product. Also, when chopping, the working parts of the apparatus wear or distort to the point that the separations are incomplete which is unsatisfactory because the incompletely chopped items, such as fiber strands, are defective and often cause defects in the application in which they are used.

Typical apparatus for, and methods of, separating or chopping, as described above are disclosed in U.S. Pat. Nos. such as

| | | | |
|---|---|---|---|
| 3,508,461 | 3,731,575 | 3,744,361 | 3,815,461 |
| 3,831,481 | 3,869,268 | 4 043,779 | 4,045,196 |
| 4,083,279 | 4,175,939 | 4,237,758 | 4,248,114 |
| 4,287,799 | 4,344,786 | 4,347,071 | 4,367,084 |
| 4,373,650 | 4,398,934 | 4,411,180 | 4,528,877 |
| 4,576,621 | 4,615,245 | 4,637,286 | 4,706,531 |
| 5,003,855 | | | |

Many of the apparatus and methods disclosed in these patents use an elastomer, thermoplastic polymer or other temperature sensitive materials in one or more key components of the chopper apparatus, such as the back up or cot roll, the blade holder, blade snugger, blade roll, etc. These temperature sensitive components, such as polyurethane, are frequently used because of their elastomeric characteristics at room temperature or assumed operating temperatures; and thus, the hardness of the component, usually critical, is specified to be within a certain range for best performance. As used herein the term chop, or derivatives thereof, are intended to mean separating the work product into shorter lengths regardless of how such separation is accomplished.

A chemical composition or mixture, usually in aqueous form, referred to as sizing, is typically applied as a coating on the fiber before the fiber is chopped. Sizings compositions exist which produce substantially improved fiber products compared with existing products, but they are impractical because they make the strands of fiber so difficult to chop that they are commercially unfeasible.

When trying to chop the hardest-to-chop fiber strands at speeds exceeding a thousand feet per minute, often at speeds exceeding 2500 or 3500 feet per minute, the blade roll frequently fails. Such failure may cause sharp blades to fly off the blade roll causing a serious safety hazard and a costly shut down. Also, when chopping the most difficult to chop strands, the blades and temperature sensitive portion of the back up or cot rolls always must be replaced after much shorter operating periods than when chopping easier-to-chop strands. For example, normally glass fiber intended for making nonwoven mat using a wet laid process are much easier to chop than glass fiber intended for reinforcing thermoplastics parts made by injection molding. Also, larger diameter glass fiber such as 16 micron is easier to chop than fine diameter such as 10 micron.

It had been delivered that the shorter component life was due only to wear. The stands, etc. are usually chopped in the presence of ambient temperature water, and the rapidly turning blade roll, back up or cot roll, and moving strand(s) move a lot of ambient air around the chopping zone. Thus, it had not been realized that a heat build up was occurring that could affect the components in a way to reduce the effectiveness of the chopping function or process and to reduce their life and cause them to fail catastrophically.

SUMMARY OF THE INVENTION

It has been discovered that the reason that difficult to chop fiber strands, etc. either cannot be manufactured in a commercially feasible manner due to either incomplete chopping or unacceptably short component life is not caused only by wear on the chopper components, but also because of undesired permanent or temporary distortion caused by heat buildup in temperature sensitive working components of the chopper. A working component is a component that either contacts the product during chopping or is a component in contact with a component that does. When heat builds up in a temperature sensitive working component or in the blades which transfer heat to one or more temperature sensitive components, the integrity and hardness of the temperature sensitive component changes allowing the part to distort during the chopping process resulting in a component failure or inoperative or incomplete chopping and shorter component life.

Heat is generated from energy created by friction between one component internally and/or two or more components and/or one or more components and the material being chopped. Also, when heat related distortion of a temperature sensitive part occurs, the less effective chopping that results may increase the rate of heat generation and temperature buildup and further accelerate component failure or an unacceptable chopping condition. For example, high speed rotation of the chopper blade roll causes centrifugal force that attempts to through the blades out of the blade roll. They are held in place partly by a heat sensitive material like polyurethane, an elastomeric material. When the polyurethane is in contact with the metal blades and as the blades cut or press some unknown distance into polyurethane working layer on the back up roll, the blades and/or the polyurethane component rise in temperature to above 200 degrees F., such as to or above 230–250 degrees F. Heat is transferred by the metal blades into other polyurethane components such as a blade holder causing the blade holder to distort catastrophically allowing pieces of polyurethane and metal blades to fly out of the blade holder or blade roll by centrifugal force.

Further, excessive temperature in the working layer or portion of the back up roll or cot, which is made from a heat sensitive material like polyurethane, causes the hardness of the heat sensitive material to drop resulting in less effective chopping and faster deterioration or wear. We have discovered that heat build up in one or more temperature sensitive working components of the chopper is an important reason, limiting the rate at which the material being chopped can be pulled through and chopped by the chopper without producing incomplete chopping or unsatisfactory chopper component life.

It has now been discovered that when one or more of the temperature sensitive key components of the chopper are cooled during the chopping process sufficiently to maintain the hardness, and other characteristic(s), of the material used to make the component within the desired range of hardness, or desired range of one or more other critical characteristics, the chopping process is much improved and the life of the key components like the back up roll, blades, blade roll, etc. are much improved. The desired range of hardness and other critical properties are conventionally specified for each new working temperature component. In accordance with the present invention, the blade roll failure problem is solved and even more difficult to chop products become commercially feasible. We also found that chopping productivity, the rate at which the product is chopped in terms of feet per minute, pounds per minute and/or number of fibers that can be chopped on a single chopper can be substantially or significantly increased. Our method and system may employ any method of cooling, provided it doesn't interfere with the other chopping requirements, or excessively alter the moisture content of the chopped product, or cool the component such that the component is out of specification at the time it contacts a chopping blade for chopping.

The present invention comprises maintaining during chopping one or more properties, exclusive of dimensions, of one or more temperature sensitive working components of a chopper for long or continuous items like fiber, tape, wire, ribbon, or strands containing a plurality of one or more of these items within the specifications established for a new component, the working components being either in direct contact with the item being chopped or in direct contact with a component that does contact the item being chopped, and exclusive of components like conventionally cooled bearings, drives, drive belts, gear boxes or electrical components, by cooling at least one of the working components with a fluid or other cold material, preferably having a temperature below 50–55 degrees F., preferably below about 40–45 degrees F. and most preferably below about 32–35 degrees F. This is typically below the temperature of plant compressed air, city water and plant process cooling water. The working components of the chopper whose temperature is reduced by cooling with a cold material include one or more of the working portion or outer layer of a back up roll or cot, the chopping blades, the blade holder and the blade snugger. According to the present invention, the temperature of working components made from a temperature sensitive material is kept below the temperature that will cause the material to go out of specification in any critical property, particularly hardness, by cooling, normally continuously, one or more components with one or more streams of cold fluid that is significantly lower in temperature than has heretofore been used on a chopper component during chopping.

The present invention also provides for means to control the temperature of the temperature sensitive components and prevent heat build up in these components. Cooling one or more parts of the chopper is preferred. Alternatively, cooling the material being chopped before it reaches the blades will also achieve desired results, if cooled sufficiently, avoiding harm to the material being chopped. According to the present invention, the cooling can be achieved by applying a cooling fluid such as cold air or other gas, a cold liquid, or a liquefied gas such as liquid nitrogen, or mixtures thereof to one or more of the components or product prior to chopping. The stream of cold fluid can be achieved in any number of ways, such as by running water or air or mixtures thereof through a heat transfer device that is cooled with refrigeration fluid, cryogenic fluid, or mechanical cooling means. According to a preferred embodiment, cold air is blown onto the working surface of a rapidly spinning back up or cot roll of the chopper striking the working surface at a distance spaced from where the blades contact or penetrate the back up roll to chop the material.

The present invention also includes an improved method of separating or chopping long items such as fiber, wire, rods, ribbon, tape, or strands made up of a plurality of one or more of the these items into short lengths of up to 3 or 6 inches at a speed exceeding 500 feet per minute, and preferably exceeding 1000, 2000 or 3500 feet per minute, using a chopping apparatus having one or more working components made of a temperature sensitive material, the working components including one or more of the working portion or layer of a back up or cot roll, a blade roll, a blade holder, and a blade snugger, the improvement comprising maintaining at least one property, such as hardness, of the material in at least one of the components within a desired range by contacting at least one of the components, preferably a temperature sensitive component, and/or said item(s) being chopped with a cold material, such as a cold fluid. The cold fluid can be a liquid such as cold water from near freezing temperature up to about 40 degrees F., or even up to about 50 degrees F., a gas such as air, nitrogen, oxygen, etc. with a temperature of less than 54 degrees and preferably below 40 degrees F. or even below about 32 degrees F., a cryogenic fluid or liquid-gas mixture or other mixtures thereof at similar or lower temperatures. Preferably, the cooling fluid is cold air having a temperature below about 35 degrees F. and the cold air is preferably directed onto the outer surface of the working portion of the back up or cot roll at a location spaced up to almost 180 degrees, such as almost about 175 degrees, upstream on the cot roll from where the blades contact the back up or cot roll for chopping.

The invention also includes an improved separating or chopping apparatus for separating long lengths of items such as fiber, ribbon, tape, wire etc. and strands made up of a plurality of one or more of these items into short lengths comprising working components including blades or blade like members for cutting, shearing or breaking said items into short lengths, a blade holder or blade roll for holding said blades, a blade snugger and a back up roll or cot roll to support or push against said items while said blade(s) work against an outer working portion of the cot roll to separate said long lengths into the short lengths, one or more of the working components being made from a temperature sensitive material, the improvement comprising a means, such as a nozzle or tube, for directing a cooling of member or material, such as a cold fluid, onto at least one of the temperature sensitive working components, the blades or the item(s) being chopped, said nozzle being sized to permit the flow of sufficient cold fluid to maintain the temperature of said temperature sensitive material below that temperature which would cause said temperature sensitive material to deform sufficiently to significantly reduce the effectiveness of the chopping function.

The invention also includes means for supplying a cold fluid, such as a gas, a liquid or mixtures thereof, to one or more of the nozzles or tubes such as a cold heat transfer device for cooling a gas or liquid, a mechanical static cooling device for cooling a gas, such as a preferred vortex tube, a source of cryogenic liquid or gas or liquid/gas mixture. Preferably, cooling fluid is directed onto the working surface of the back up or cot roll at a distance spaced from the location of chopping, i.e. the nip between the blades or blade roll and the back up roll and preferably in a range of 175 to 90 degrees upstream of the chopping location. The nozzle or tube for directing the cooling fluid is preferably sized to cause the cooling fluid to contact and cool the working portion of the component such as the working portion of the back up roll entirely across its width and at least in the area where the blades do the chopping. While the cooling may not be uniform across the width of the component, it is desirable, but not necessary to bring the temperature of the working surface to a uniform or reasonably uniform temperature across its width.

DETAILED DESCRIPTION OF THE INVENTION

Figure 1:
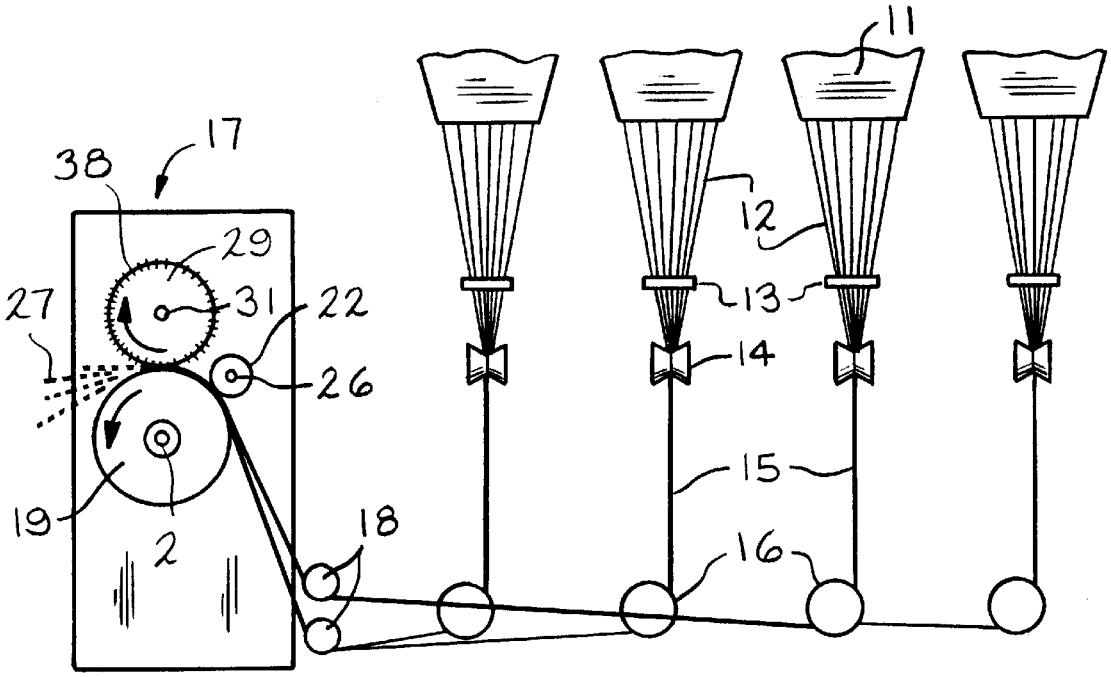
FIG. 1 PRIOR ART
FIG. 1 is a schematic of a typical prior art operation for making chopped fiber strands.

The present invention is especially suited for use in making chopped strand products like chopped fiber glass, mineral fiber, ceramic fiber and various natural and synthetic organic polymer fibers. For purposes of illustration here, the making of chopped fiber glass strand using the present invention will be described. FIG. 1 is a schematic of a typical fiber glass chopped strand operation. An array of glass fibers 12 are formed when molten glass flows through holes or nozzles (not shown) in the bottom of fiberizing bushings 11 and are pulled at high speeds of more than 500 feet/minute (fpm) to speeds over 2500 fpm or even over 3500 fpm up to 10,000 fpm or more, to attenuate the fibers to the desired diameter and to maximize productivity. The fibers are pulled with a chopper 17.

A blend of chemicals of various kinds, usually an aqueous blend, depending on the product being made and the company making the fiber product, is applied to the fiber by pulling the fibers over a known type of sizing applicator 13. Many kinds of chemical sizing compositions are known and since the sizing composition, or even its presence, is not a part of the present invention, sizing compositions are not described here. The present invention is useful with fiber, etc. having no sizing or any known sizing composition on their surfaces and, as mentioned earlier, is most useful on the most difficult to chop fiber strands.

After the sizing is applied, the fibers are pulled together with an optional V-shaped gathering wheel 14 into a fiber strand 15 and usually pulled around a turning wheel 16 of any known design. Normally a number of fiberizing bushings 11 are aligned along a forehearth leg or feeder of a glass furnace such that several strands are pulled and chopped by a single chopper, often up to 15 strands or more. The strands are also pulled partly around one or two grooved guide rolls 18 prior to entering the chopper to separate the strands into parallel strands as the strands enter a nip between a pull or idler roll 22 and a back up or cot roll 19, both of which are part of a chopper 17, such as the chopper disclosed in U.S. Pat. No. 4,083,279. These rolls 19 and 22 are pressed together to form a nip and are rotating with the use of shafts 23 and 26 respectively and mounted bearings (hidden from view) in a known manner in a direction to pull the fiber strands. Normally, at least one of these rolls is driven.

A surface portion 21 of the back up roll 19 is made from a temperature sensitive material and, depending on the kind of material being chopped, such as glass fiber, an elastomer with a certain range of hardness is used. A preferred material for this purpose is polyurethane having a Shore A durometer hardness of about 85 to about 95. The thickness of the elastomer is typically at least about 0.25 inch and preferably starts out at about 0.75 inch or more thick and decreases in thickness with wear and resurfacing. The strands 15 tend to stay on the working outer surface of the back up roll outer portion 21 and are carried into contact with a chopping blade 38 mounted in a blade roll 29 that rotates on a shaft 31 and cooperates with the working portion 21 of the back up roll 19 to chop the strands 15 into short segments of chopped strand 27.

Figure 2:
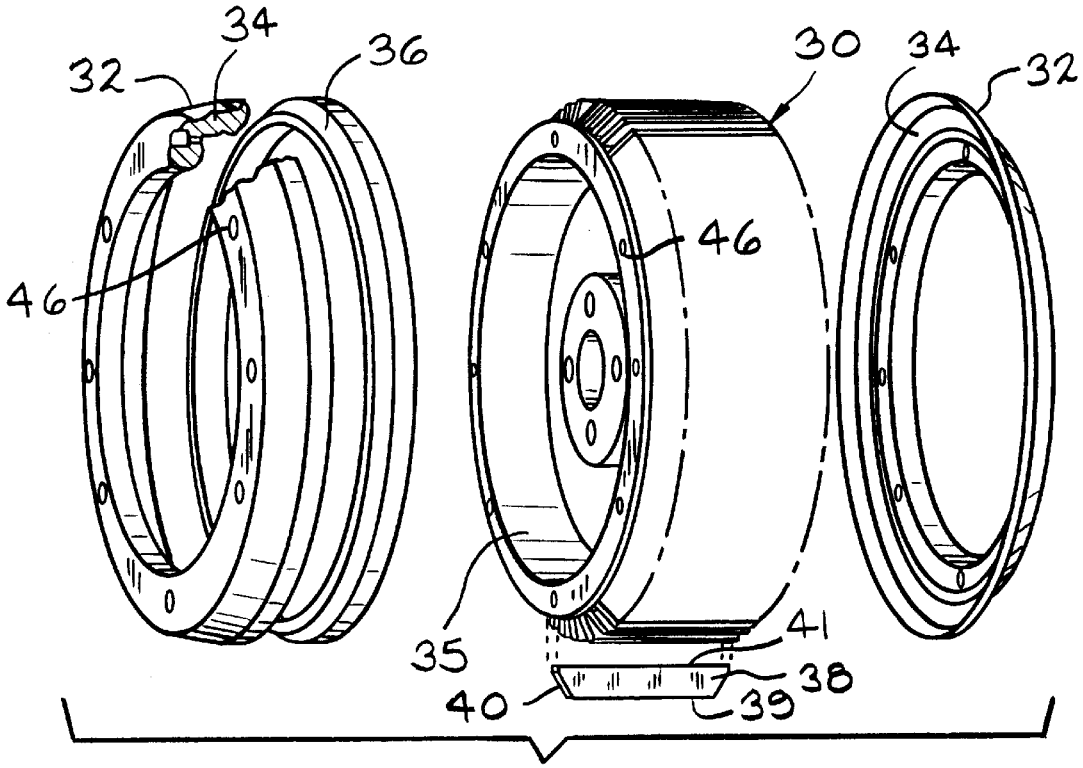
FIG. 2 PRIOR ART
FIG. 2 is a partial perspective view of a prior art blade roll of a prior art chopper, partially cut away to better show temperature sensitive components.
Figure 3:
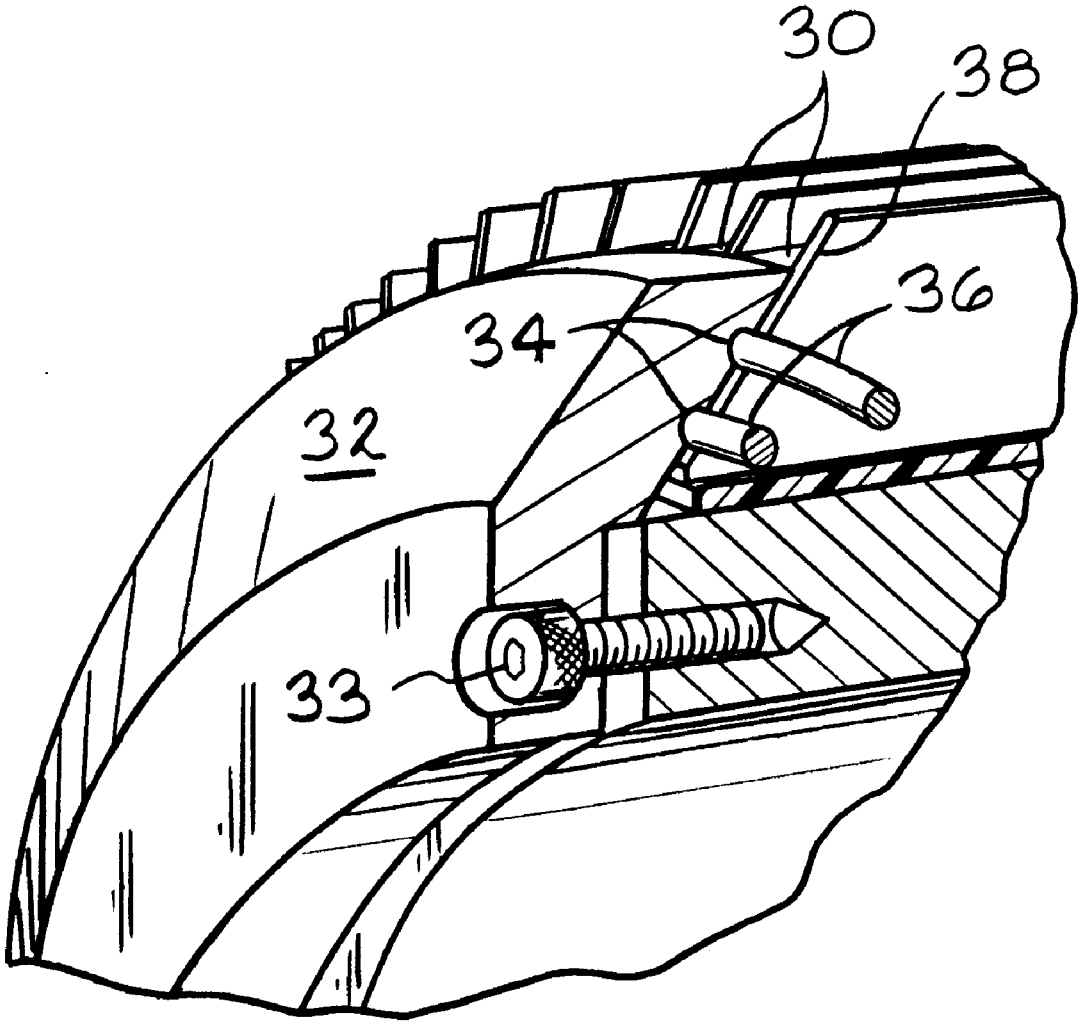
FIG. 3 PRIOR ART
FIG. 3 is an exploded view of the blade roll shown in FIG. 2.

FIGS. 2 and 3 show a typical known blade roll 29 in more detail. The blade roll 29 comprises a metal wheel 35. Mounted or cast onto the outer surface of the wheel 35 is a blade holding layer 30, preferably made from a temperature sensitive material such as polyurethane having a Shore A durometer hardness of about 95 to 105. The outer edges of the blade holder layer 30 are tapered at an angle to match the angle on the ends of blades 38. Slots are formed across layer 30 to accommodate the blades 38 in the manner shown and described in more detail in U.S. Pat. No. 4,083,279. The blades 38 have a short straight portion 41 and a longer period tapered portion 40 on each end, and a razor sharp edge 39 projects above the outer surface of the layer to cooperate with the working portion 21 of the back up roll 19 to chop the strands of fibers. The blades are held in place with one blade retaining rim or ring 32 secured to each side of the blade roll 29 with a plurality of threaded bolts 33 that pass through holes 46 in the metal rims 32. Each of the two metal retaining rings 32 are pulled tightly against the blade snugger by tightening bolts 33 into threaded portions of the wheel 35.

To compensate for slight variations in the lengths or taper angles of the blades 38 and the dimensions of the rims 32, one or more slots 34 are machined in the tapered inner surface of each of the retaining rims 32 to hold malleable or elastomeric material such as copper or temperature sensitive nylon wire or cord 36. The wire or cord 36 will snug the tapered ends of the blades 38 when the bolts 33 are tightened and hold the blades tight to prevent blade movement and chattering during chopping. Instead of wire or cord, a band of temperature sensitive material like polyurethane, nylon or higher temperature thermoplastic material, preferably measuring about 0.5 inch wide and about 0.125 inch thick can be used instead without any slot machined for it in the rings 32.

In operation on glass fiber strands, the blade edges 39 and blades 38 penetrate the working layer of elastomeric material 21. The harder the strands are to chop, the deeper the blades penetrate into the layer 21. It has been discovered that the movement of the blades 38 and, to some extent, the fiber strands 15 into and out of the elastomeric layer 21 causes the elastomeric layer 21 and the blades 38 to build up heat and temperature and, after a period of time, to reach a temperature that causes the durometer hardness of one or more of the working layer 21 of the back up roll, the blade holder layer 30 and the blade snugger 36 to fall below the specified range. When that happens, one or more undesirable things happen. The most catastrophic is that the blade holding layer 30 fails due to its lack of integrity and centrifugal force, throwing off chunks of temperature sensitive material and blades. This causes a serious safety hazard and a costly shut down to replace the blade roll, etc. During chopping the working layer 21 of the back up roll 19 becomes too soft and results in incompletely chopped strands, again requiring the operation to be shut down to change the back up roll 19 and/or working layer 21. Further, the blade snugger 34 and the blade holding layer 30 become too soft allowing the blades to move and chatter even before layer 30 fails catastrophically. Any one or a combination of these undesirable problems occur and significantly increase the cost of the chopped strand product, sometimes to a prohibitive extent. One solution has been to slow down the chopping speed which reduces productivity and also increases cost. Solving these problems, or substantially increasing the chopping speed where they occur, is very valuable to each operation, which typically would have many choppers operating at the same time.

The present invention is based in part on the discovery of this heat and temperature build up problem and that adequate cooling of at least one of the working components, such as the working layer 21, the blades 38, the blade roll 29, the blade holding layer 30 and the blade snugger 34, either directly or indirectly, results in elimination of at least one of the above described problems or in greatly reducing its cost impact on the chopped strand operation. Preferably, the cooling is controlled to maintain the durometer hardness of each of the temperature sensitive blade roll and back up roll parts within the appropriate specification, depending on the part and material, for each such component.

Figure 4:
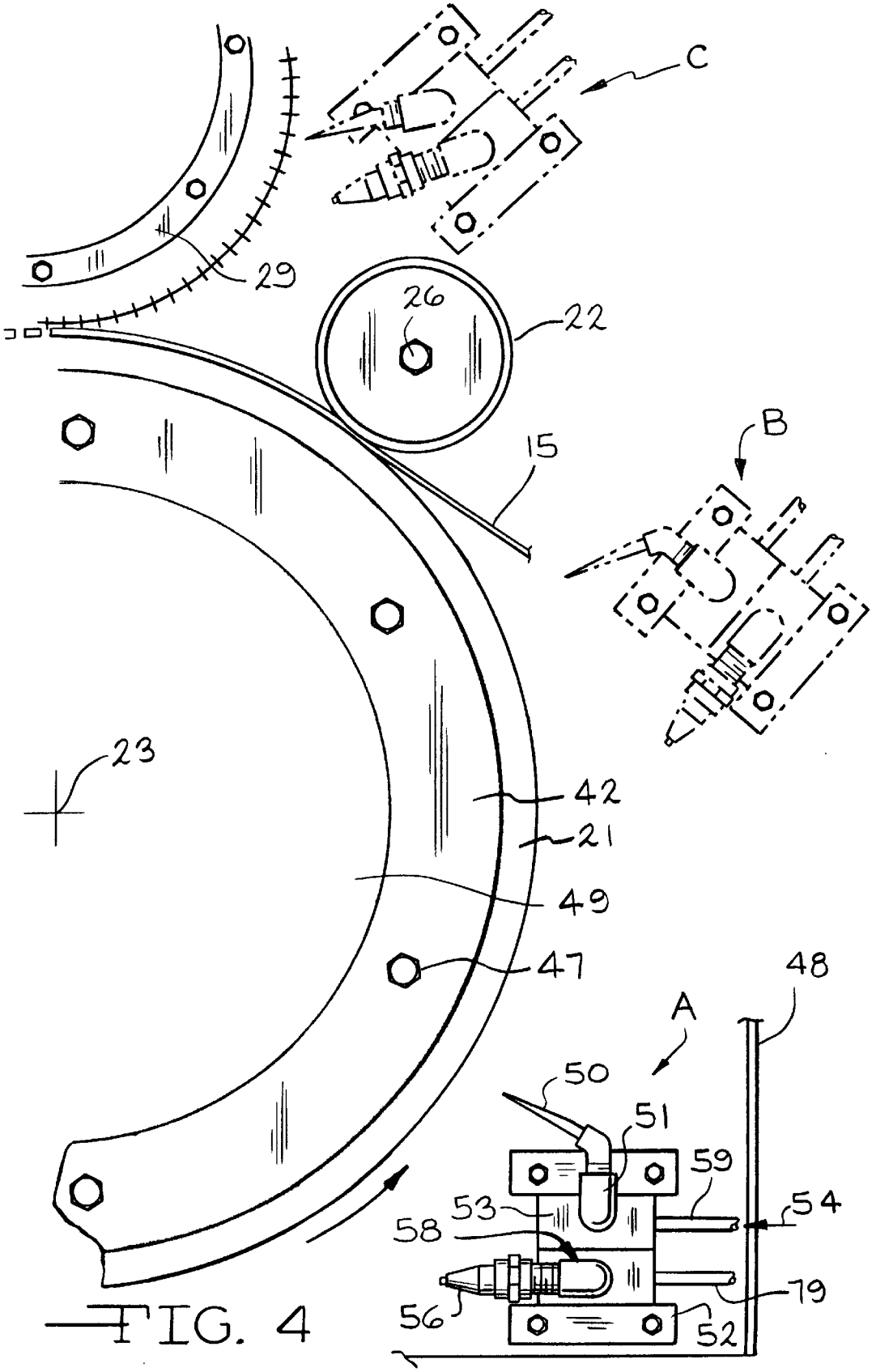
FIG. 4 is a partial front view of a chopper showing the working surface of a back up roll being cooled according to a preferred embodiment of the present invention.
Figure 5:
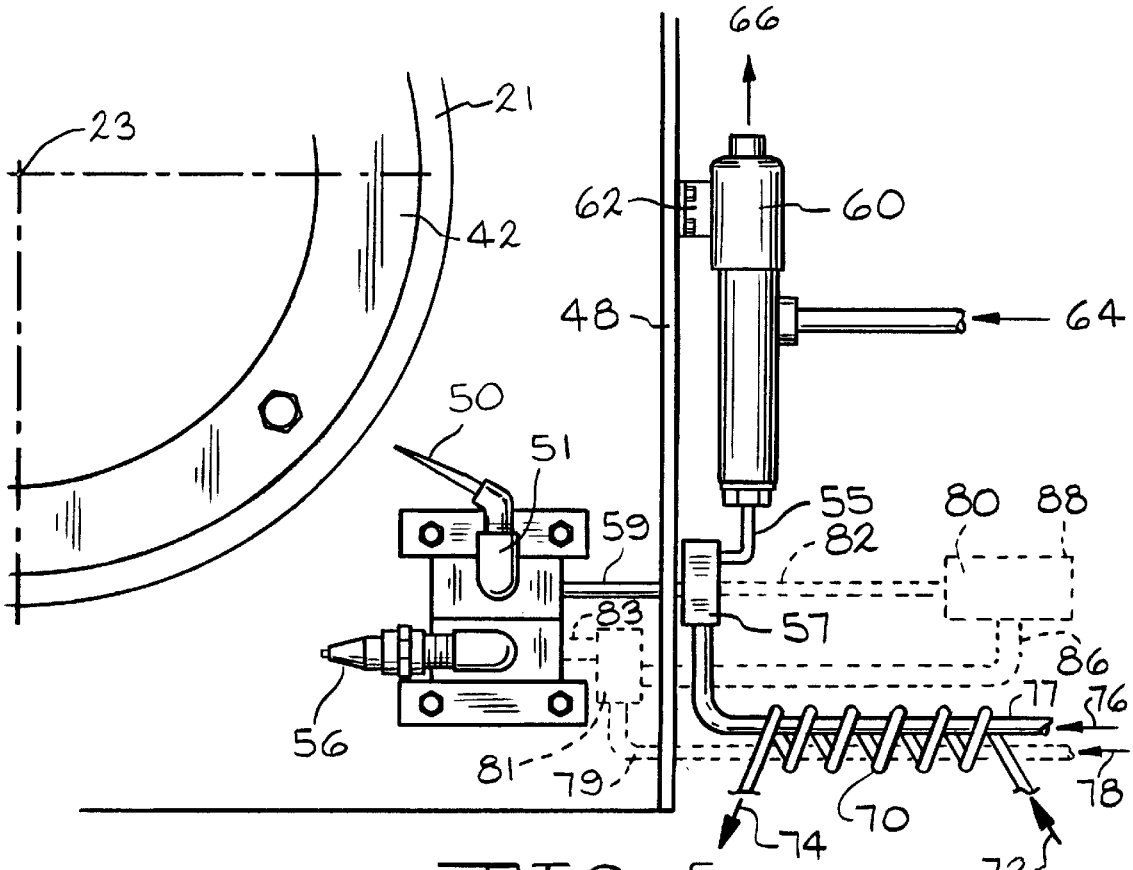
FIG. 5 is a duplication of a portion of FIG. 4 further showing the preferred way of supplying the cooling fluid and also showing several optional apparatus and ways of practicing the invention.
Figure 6:
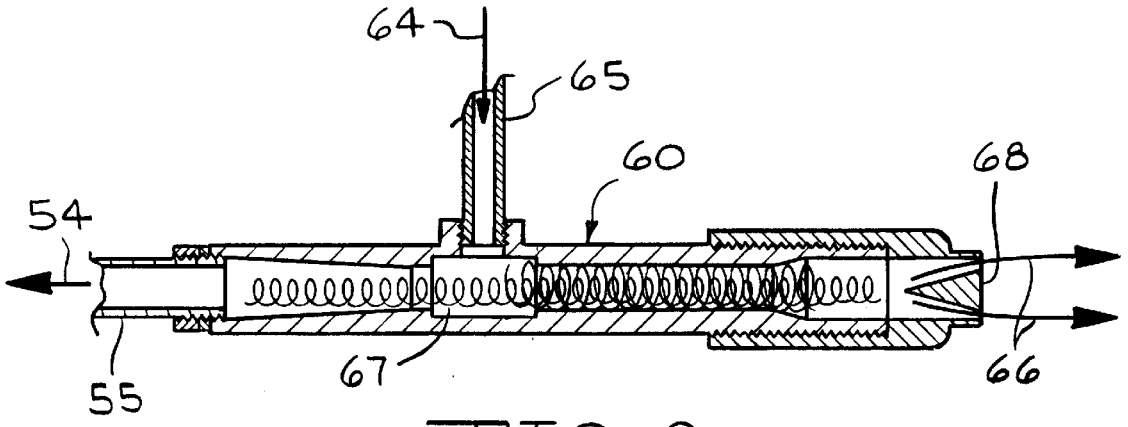
FIG. 6 is a cross sectional view of a vortex tube cooler which is preferably used to supply the cooling fluid in the invention.

The preferred and optional embodiments of the present invention are illustrated in FIGS. 4–6. FIG. 4 is an enlarged view of a portion of a chopper showing portions of the working parts most important to the description of the invention and also shows part of the preferred embodiment apparatus. Here, a metal back up wheel outer rim 42 having a temperature sensitive polyurethane layer 21 on its outer surface is held in place on a drive hub 49 with bolts 47. The back up roll working portion or layer 21 is rotating counterclockwise and the strands 15 are pulled into the chopper from the right side.

FIGS. 4 and 5 show the preferred location A for a cooling nozzle 50 attached to an elbow fitting 51 attached to a flange 53 of a bracket 52 attached to a portion (not shown) of frame 48. The gas nozzle 50 can be of various kinds, or even just a pipe or tube, so long as it directs a cold fluid 54, coming to the nozzle 50 through tubing 59, fairly uniformly onto the outer or working surface of the working portion 21 of the back up roll. Preferably, but not necessarily, all tubing, fittings and valves handling the cooling fluid on this and all embodiments are made from a low mass, relatively low thermal conductivity material like various plastics and are further thermally insulated to keep the cooling fluid from gaining temperature on the way to nozzle 50 or other nozzles. Metal tubing, valves, and fittings can be used, but may frost and the cost of supplying cooling fluid will be somewhat higher. Preferred tubing for the cooling fluid is 0.375 inch Legris tubing and fittings which are readily available.

The preferred nozzle 50 for cooling a working portion 21 about 4 inches wide is a Windjet™ Blow-Off nozzle Model #Y727-Al available from Spraying Systems Co. of Wheaton, Ill. This nozzle is preferably mounted such that its longitudinal axis is generally perpendicular to the tangent of the outer surface of the temperature sensitive working portion 21 for best cooling efficiency, but other angles would also be operable. The end of the nozzle 50 is preferable just far enough away from the outer surface of portion 21 to not interfere with anything on the outer surface of portion 21 and such that the entire width of portion 21 is cooled by the cool fluid coming from nozzle 50. Although a range of positions and distances from the outer surface of the working portion 21 are suitable for the nozzle 50, the preferred embodiment distance of the end of the nozzle from the outer surface of a new working portion 21 is about 0.5 inch, and this distance increases to about 0.88 inch during the life of the working portion 21 due to wear and redressing of the surface.

Any known way of providing cold to the component, such as a cold fluid 54 is suitable, whether a cooling gas such as air, carbon dioxide, nitrogen, etc., a cold liquid such as water or a cold mixture of a gas and a liquid such as a mixture of air and liquid nitrogen or volatilized liquid nitrogen. Cold air is preferred, or a combination of cold air and cold water, for cooling the temperature sensitive components of a chopper, and any known way of providing a cold stream of air is acceptable provided it provides the degree of cooling desired. Different choppers, different temperature sensitive materials, different running speeds and strand loadings, different products and different numbers of fibers, etc. will change the amount of cooling needed to practice the invention. It is within the skill of the artisan to determine what is required for any reasonably situation given this disclosure.

The preferred way of cooling an air stream to provide the cold fluid 54 is shown in FIGS. 5 and 6. In this embodiment a vortex tube cooler 60 mounted on the chopper frame 48 with bracket 62 is supplied with plant compressed air 64 in a pressure range of about 90–110 preferred psig via gas line 65. Dry compressed air is preferred, but not necessary so long as the compressed air does not contain so much water that it causes condensation which can freeze and plug the lines, etc. The vortex tube, because of its internal design, causes the compressed air to start rotating creating a vortex in the initial chamber 67 as shown in FIG. 6. The vortex separates into two streams, one hot air 66 that exists one end of the vortex tube 60 and the other cold air 54 that exists the other end through tubing 55. A control valve 68 at the hot exhaust end can be adjusted to limit the "cold fraction" and to control the temperature of the cooling gas 54 exiting the vortex tube 60. Preferably, the control valve is set wide open when chopping ten strands of at least 2000 fibers each at a speed in the range of about 3500–4200 fpm or higher.

Vortex tubes are well known for supplying either hot or cold fluid streams. The vortex tube used in the preferred embodiment was a #160 air gun model 208-15H made by ITW Vortec of Cincinatti, Ohio, but other vortex tubes would be acceptable, particularly those having a greater cooling capacity, as would other means of cooling a fluid stream.

It has been discovered that cooling the working portion 21 of the back up roll or cot as shown in FIGS. 4–6 and as described above results in the elimination of one or more of a catastrophic failure of the blade roll, elimination of blade chattering, ability to chop glass fibers at an acceptable rate and cost that heretofore could not be achieved with the chopper 17. The invention also allows increased chopping rates in terms of either higher running speeds and/or greater weight output of chopped product per unit of time. A cooled working portion 21 of the back up roll prevents heat build up not only in the working portion 21, but also in the chopping blades and temperature sensitive components of the blade roll.

In the preferred mode a water spray nozzle 56 may be used but for a different purpose than had been in use when the problems of overheating and failure were occurring. Nevertheless, water nozzle 56 serves to provide some cooling. The primary purpose of the nozzle 56, which may spray a jet of water, such as city water at near ambient temperature and always above about 55 degrees F., to strike the outer or working surface of portion 21 at or around bottom dead center, is to clean the outer surface, particularly when the outer surface was being dressed with a dressing tool (not shown).

In accordance with the invention, spray system 58 containing nozzle 56, or another nozzle of same or similar type, located in various places as described above for the nozzle 50, can be used alone or with the fluid nozzle 50 to also practice the present invention by feeding cold water to the nozzle 56. A preferred type of nozzle for nozzle 56 is disclosed U.S. Pat. No. 4,438,884 and is available from Spraying Systems Co. of Wheaton, Ill. as Quick Release QVV -SS-40067 mounted on a 0.25 inch QJ Quick Jet™ holder, but many types of spray nozzles could be used.

Any alternative method of producing the cold water for this or a similar nozzle, tube or pipe would be suitable. The temperature of the cold water, or other cooling liquid, fed to a spray nozzle 56 may vary depending on the product being chopped, the running speed, the nature of the temperature sensitive material and the rate of cooling liquid emitted by the nozzle, all of which can be determined on any particular set up with a minimum of experimentation. One can start with a temperature substantially colder than thought necessary and gradually raise the temperature until undesirable results follow to optimize the operating conditions, or vice versa. Normally, it would not be desirable to spray cold water on the incoming fiber as it might remove part of the sizing on the fiber.

Other locations of the cooling nozzle 50 around the working portion 21 of the back up roll are suitable although it is preferred to place the nozzle 50 such that the cooling fluid strikes the outer or working surface of the back up roll 19 at a location between just past bottom dead center of the roll 19 and the location of the idler roll 22 since most fiber, sizing or other material being thrown off the working surface of the back up roll is removed before the location is reached.

Alternative suitable locations for the cooling nozzle 50 are shown in phantom in FIG. 4 at B and C, including positions that cool the blades, the blade holder 30 and other components of the blade roll 29 or the incoming strands 15. Other possible positions in addition to those shown would be suitable as the skilled artisan would recognize. Two or more cooling nozzles 50 can be used to affect cooling of one or more temperature sensitive components.

Alternative ways of supplying a cooling fluid, a gas or a liquid, to the fluid nozzle 50 or liquid spray nozzle 56 are illustrate in FIG. 5. A conventional cooling coil 70 such as a refrigerant coil used to cool freezers, etc. could be used to surround and cool one or both of a gas or air line 77 supplied with air 76, or other suitable gas, under pressure and at the desired rate, and a water line 79 fed with water 78, or other suitable liquid, at the desired pressure and/or rate. Cold refrigerant fluid 72 from any known source such as a refrigerant compressor enters the cooling tube at a desired temperature and rate and warmer refrigerant fluid 74 is recycled back to a heat exchanger to be recooled.

It is also possible to use cryogenic fluids such as air, nitrogen, carbon dioxide, oxygen, etc. to provide the cooling function, but it is best to use them to cool a gas like air or a liquid like water to avoid embrittleing the temperature sensitive components being cooled. FIG. 5 also illustrates how this is done. A source 88 of cryogenic fluid 80, such as a pressurized container, can be fed into either cold water line 83 via pipe 86 and a conventional control and blending valve 81, or into the cooling fluid line 59 via pipe 82 and a conventional control and blending valve 57. The control and blending valves 57 and/or 81 also can permit any desired combination of cooling scenarios described here or other suitable alternatives in selecting and operating one or more of these valves. The pipes 82 and 86 are preferably of a material suitable for transporting cryogenic fluids and properly insulated.

While the chopping of glass fiber was used to describe the invention, this invention will also facilitate the separation of other materials and shapes as described above. When chopping a material that is softer than the blades such as polyester, nylon, polypropylene, etc., the working portion 21 of the back up roll would have a different durometer range, usually higher, but it would still be important to keep the hardness within the specified range.

Other ways of cooling one or more of the temperature sensitive components of various choppers would be obvious to the skilled artisan having the benefit of this disclosure and are intended to be included within the scope of the claims below.

What is claimed is:

1. A method of completely chopping continuous items selected from the group consisting of fiber, wire, ribbon, tape, and strands made up of a plurality of one or more of these items into lengths of one inch or less as said items are continuously pulled into a chopping apparatus at a speed exceeding 1000 feet per minute, said chopping apparatus having working components comprising a rotating back up or cot roll and a plurality of blades mounted in a rotating blade roll with at least one of the working components made at least partly of a temperature sensitive thermoplastic polymer or elastomeric material, said at least one of the working components including one or more of a working portion of the back up or cot roll, the blade roll, a blade holder, and a blade snugger, the improvement comprising maintaining at least one critical property of the temperature sensitive thermoplastic polymer or elastomeric material of the at least one said component within specifications by cooling the temperature sensitive thermoplastic polymer or elastomeric material using a cold substance having a temperature of less than 50 degrees F.

2. The method of claim 1 wherein said cooling comprises contacting said at least one temperature sensitive component and/or said item(s) being chopped with the cold substance that is a fluid.

3. The method of claim 2 wherein said fluid is a gas.

4. The method of claim 3 wherein said gas is air having a temperature of less than about 45 degrees F.

5. The method of claim 3 wherein said gas is air having a temperature below about 35 degrees F.

6. The method of claim 2 wherein said fluid is a cold liquid having a temperature of less than 45 degrees F.

7. The method of claim 2 wherein said fluid is a mixture of air and a vaporized cryogenic fluid and wherein the temperature of the mixture is less than about 32 degrees F.

8. The method of claim 4 wherein said item comprises strands of glass fibers having a chemical sizing on their surface and the cold air is applied to the outer surface of the working portion of the back up or cot roll.

9. The method of claim 8 wherein said temperature sensitive components are made from polyurethane and the chopping speed is at least 2500 feet per minute.

10. A method of chopping continuous fiber or strands made up of a plurality of fibers into lengths of one inch or less as said fiber or strands are continuously pulled and move into a chopping apparatus at a speed exceeding 1000 feet per minute, said chopping apparatus having working components comprising a rotating back up or cot roll and a plurality of chopping blades mounted in a blade roll with at least one of the working components containing a temperature sensitive thermoplastic polymer or elastomeric material, the working components including one or more of a working portion of the back up or cot roll, the blade roll, a blade holder, and a blade snugger, the improvement comprising maintaining at least one critical property of the temperature sensitive thermoplastic polymer or elastomeric material in at least one of the working components within a desired range by contacting at least one thing from a group consisting of the blade roll, the back up or cot roll and said fiber or strands with a cold substance having a temperature of less than about 50 degrees F.

11. The method of claim 10 wherein said fiber is glass fiber.

12. The method of claim 11 wherein said substance is a fluid.

13. The method of claim 12 wherein said fluid is a gas.

14. The method of claim 13 wherein said gas is air having a temperature of less than about 45 degrees F.

15. The method of claim 13 wherein said gas is air having a temperature below about 35 degrees F.

16. The method of claim 12 wherein said fluid is a cold liquid.

17. The method of claim 12 wherein said fluid is a mixture of gas and liquid.

18. The method of claim 12 wherein said fluid is a mixture of air and a vaporized cryogenic fluid and wherein the temperature of the mixture is less than about 32 degrees F.

19. A chopping apparatus for separating continuous items selected from the group consisting of fiber, wire, ribbon, tape, and strands made up of a plurality of one or more of these items by pulling one or more of these items into the chopping apparatus at a speed of at least 1000 feet per minute, said apparatus comprising components including a rotatable blade roll including a blade holder and a plurality of blades for chopping and a back up roll or cot having a working layer to support or push said items while said blades work to separate said items into the lengths of one inch or less, said rotatable blade roll, blades, and rotatable back up roll or cot mounted in said chopping apparatus such that as the blade roll and back up roll or cot rotate, each of the blades come into contact with and penetrate into said working layer, one or more of the components including the blade roll and the back up roll or cot being at least partly made from a temperature sensitive thermoplastic polymeric or elastomeric material, the improvement comprising means for maintaining the temperature of the temperature sensitive material in at least one of the components, said means including means for cooling a fluid to a temperature below 50 degrees F. and for directing said fluid onto one or more of the blade roll, the back up roll or cot and the items being chopped to maintain the temperature of said temperature sensitive material below that which would cause said material to deform in such a way as to reduce the effectiveness of the chopping function.

20. The apparatus of claim 19 wherein the temperature sensitive material is selected from the group consisting of polyurethane, an elastomeric material, a thermoplastic material, and a thermoset material.

21. The apparatus of claim 20 wherein said directing means comprises a nozzle, tube or pipe.

22. The apparatus of claim 21 wherein said means for cooling a fluid is a means for cooling the fluid to below about 45 degrees F.

23. The apparatus of claim 22 wherein said means for cooling a fluid comprises a vortex tube that uses compressed air flowing through a specially shaped chamber to produce cold air having a temperature of below about 45 degrees F. for said nozzle, tube or pipe.

24. The apparatus of claim 21 wherein the directing means is located to direct the cooled fluid onto the working layer of the back up or cot roll.

25. The apparatus of claim 24 wherein said cold fluid comprises air having a temperature lower than 35 degrees F. and the temperature sensitive material is polyurethane.

* * * * *